US007791469B2

(12) United States Patent
Chen et al.

(10) Patent No.: US 7,791,469 B2
(45) Date of Patent: Sep. 7, 2010

(54) SHORT RANGE WIRELESS TRACKING AND EVENT NOTIFICATION SYSTEM FOR PORTABLE DEVICES

(75) Inventors: Jiwei Chen, Santa Clara, CA (US); James Lam, Pleasanton, CA (US)

(73) Assignee: O2Micro International Limited, Grand Cayman (KY)

( * ) Notice: Subject to any disclaimer, the term of this patent is extended or adjusted under 35 U.S.C. 154(b) by 358 days.

(21) Appl. No.: 11/546,635

(22) Filed: Oct. 11, 2006

(65) Prior Publication Data

US 2007/0080824 A1 Apr. 12, 2007

Related U.S. Application Data

(60) Provisional application No. 60/726,007, filed on Oct. 11, 2005.

(51) Int. Cl.
*G08B 1/08* (2006.01)

(52) U.S. Cl. ..... 340/539.13; 340/539.11; 340/573.4

(58) Field of Classification Search ..... 340/539.13, 340/539.11, 539.21, 573.1, 573.4, 825.49
See application file for complete search history.

(56) References Cited

U.S. PATENT DOCUMENTS

| | | | | | |
|---|---|---|---|---|---|
| 5,119,072 | A * | 6/1992 | Hemingway | ..... | 340/573.1 |
| 5,640,146 | A * | 6/1997 | Campana, Jr. | ..... | 340/573.4 |
| 5,936,529 | A * | 8/1999 | Reisman et al. | ..... | 340/573.1 |
| 6,057,759 | A * | 5/2000 | Marsh | ..... | 340/539.11 |
| 6,075,443 | A * | 6/2000 | Schepps et al. | ..... | 340/573.4 |
| 6,084,517 | A * | 7/2000 | Rabanne et al. | ..... | 340/573.4 |
| 6,529,131 | B2 * | 3/2003 | Wentworth | ..... | 340/573.1 |
| 6,559,767 | B2 * | 5/2003 | Huang | ..... | 340/539.11 |
| 6,577,239 | B2 * | 6/2003 | Jespersen | ..... | 340/539.11 |
| 6,614,350 | B1 * | 9/2003 | Lunsford et al. | ..... | 340/539.11 |
| 7,113,089 | B2 * | 9/2006 | Ho | ..... | 340/539.13 |
| 7,385,513 | B2 * | 6/2008 | Everest et al. | ..... | 340/573.1 |
| 7,439,872 | B2 * | 10/2008 | Hiltunen | ..... | 340/825.49 |
| 2005/0280546 | A1 * | 12/2005 | Ganley et al. | ..... | 340/573.4 |

* cited by examiner

*Primary Examiner*—John A Tweel, Jr.

(57) ABSTRACT

A method and system for tracking a portable device. A tracking system includes a portable device, a first Radio Frequency (RF) module, and a second RF module. The first Radio Frequency (RF) module is installed in the portable device for transmitting a wireless signal. The second RF module is used for receiving the wireless signal. When a received amplitude of the wireless signal that is received by the second RF module is less than a predetermined value, the second RF module generates an alert.

19 Claims, 4 Drawing Sheets

SHORT RANGE WIRELESS TRACKING AND EVENT NOTIFICATION SYSTEM FOR PORTABLE DEVICES

CROSS REFERENCE TO PROVISIONAL APPLICATION

This application claims priority to the co-pending provisional patent application Ser. No. 60/726,007, entitled "Short Range Wireless Tracking And Event Notification System For Portable Devices Intelligent," with filing date Oct. 11, 2005, and assigned to the assignee of the present invention, which is herein incorporated by reference in its entirety.

TECHNICAL FIELD

This invention relates to a tracking system for portable devices, and more specifically, to a system for indicating that a corresponding portable device remains within a short distance, and for notifying some special event of the portable device by using a wireless technique.

BACKGROUND ART

Portable devices like cellular phones, notebook computers, personal digital assistants (PDA), global position systems (GPS), cameras, camcorders, and music players are becoming more and more popular globally. Due to their relatively high price, high popularity and small size, it is more and more important to track such kinds of devices to make sure that they are within a safe range of their owners.

It is possible that these devices may be left on the table due to the incaution of their owners, for example, leaving the device in a restaurant or public restroom. This creates not only economic loss but also intellectual loss. Intellectual loss is incurred since important personal information and documents stored in these portable devices may also be lost at the same time without any suitable means for recovering these privacy records.

Moreover, as the sizes of portable devices become smaller and smaller, these devices are more likely to be put into a fashionable purse or pocket. As a result, the indication sound of some instant event, for example, a call ring for a cellular phone, or a scheduled alarm of PDA, is attenuated. The attenuated voice may be too low to be heard in a noisy environment. For those events that need an instant response, a missed call precludes taking advantage of some business opportunity or the handling of personal affairs in a timely fashion.

SUMMARY OF THE INVENTION

The present invention provides a tracking method and system for tracking a portable device. In accordance with one embodiment of the present invention, a tracking system comprises a portable device, a first Radio Frequency (RF) module, and a second RF module. The first Radio Frequency (RF) module is installed in the portable device for transmitting a wireless signal. The second RF module is used for receiving the wireless signal. When a received amplitude of the wireless signal that is received by the second RF module is less than a predetermined value, the second RF module generates an alert.

BRIEF DESCRIPTION OF THE DRAWINGS

Features and advantages of embodiments of the claimed subject matter will become apparent as the following Detailed Description proceeds, and upon reference to the Drawings, wherein like numerals depict like parts, and in which:

DESCRIPTION OF THE EMBODIMENT

Reference will now be made in detail to the embodiments of the present invention, short range wireless tracking and event notification system for portable devices intelligent communication. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
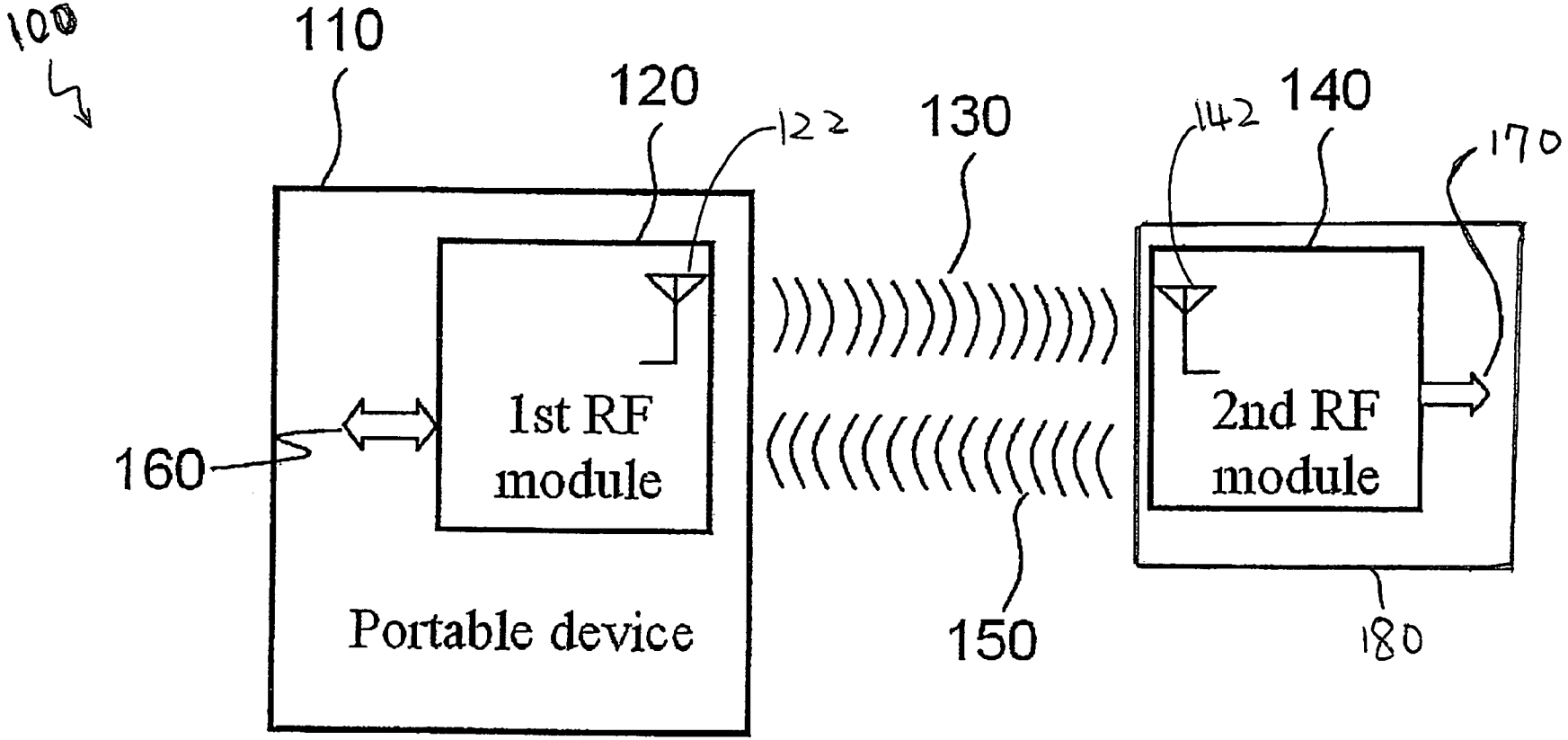
FIG. 1 is a block diagram of a RF system, in accordance with one embodiment of the present invention.

Referring to FIG. 1, a tracking system 100, in accordance with one embodiment of the present invention, is illustrated. The tracking system 100 includes a first radio frequency (RF) module 120 and a second RF module 140.

In accordance with one embodiment of the present invention, the first RF module 120 is installed in a portable device 110 (e.g., a cellular phone, a notebook computer, a personal digital assistant (PDA), a global position system (GPS) device, a camera, a camcorder, a music player, etc.). The first RF module 120 communicates with the portable device 110 through bi-directional signals 160. Via the bi-directional signals 160, the portable device 110 is able to disable or enable the first RF module 120. The second RF module 140 is installed in a handheld device 180. According to an embodiment of the present invention, the handheld device 180 includes an alarm or a display, not shown, for generating an alert or displaying a message, which will be described hereinafter in detail.

For, example, during use of the tracking system 100, a user, who can be the owner of the portable device 110, such as a cellular phone, will enable the first RF module 120 through the cellular phone 110. The handheld device 180 as well as the second module 140 are turned on. The handheld device 180 can be formed as any type of handheld device, such as a watch, jewelry, clothes, sunglasses, a key case or a key chain, which is carried by the owner. In one embodiment, once the cellular phone 110 is stolen or is away from the handheld device 180 by a predetermined distance, such as 5-10 meters, the handheld device 180 will generate an alert to remind the owner that the cellular phone 110 is out of a predetermined range from the owner.

In accordance with one embodiment of the present invention, the first RF module 120 comprises a transmitting antenna 122 for transmitting a wireless signal 130. In addition, the second RF module 140 comprises a receiving antenna 142 for receiving the wireless signal 130. While the first RF module 120 sends out the wireless signal 130 through the transmitting antenna 122, the second RF module 140 detects and receives the wireless signal 130 through the receiving antenna 142. By processing and monitoring the wireless signal 130, the second RF module 140 is capable of determining or calculating the amplitude of the received wireless signal 130. It will be apparent to those skilled in the art that the amplitude of the wireless signal is inversely proportional to the cube of the distance from the transmitting source. Therefore, the amplitude of the wireless signal can be used to determine the distance between the first RF module 120 and the second RF module 140.

In one embodiment, the first RF module 120 periodically transmits the wireless signal 130. The second RF module 140 periodically receives the wireless signal 130 and then calculates the amplitude of the received wireless signal 130 so as to periodically calculate the distance between the first and second RF modules 120 and 140, i.e., the distance between the portable device 110 and the handheld device 180. If the amplitude of the received wireless signal 130 is lower than a predetermined value, this indicates the distance between the first and second RF module 120 and 140 is larger than a predetermined distance. As a result, the second RF module 140 generates a signal 170 and transmits the signal 170 to the handheld device 180. According to the signal 170, the handheld device 180 will generate an alert or display a warning message notifying the holder of handheld device 180 that the portable device 110 is separated from handheld device 180 by a greater distance than intended. For example, signal 170 may indicate to the holder of handheld device 180 that portable device 110 is lost or stolen. As such, the holder of handheld device 180 can take appropriate measures to locate portable device 110.

As such, once the portable device 110 is taken away from the holder of the handheld device 180 by a predetermined distance, it is presumed that the portable device 110 is stolen or is forgotten and the alert will be generated by the handheld device 180 to remind the owner or the user. The system 100 is provided with a theft proof function.

In another embodiment, the first RF module 120 continuously transmits the wireless signal 130. The second RF module 140 continuously receives the wireless signal 130 and calculates the amplitude of the wireless signal 130 so as to calculate the distance between the first and second RF modules 120 and 140. In this manner, the present embodiment provides a theft proof function. That is, as soon as the distance between the first RF module 120 and the second RF module 140 exceeds a predetermined distance which may indicate the portable device 110 has been stolen, the owner or holder of the handheld device 180 is notified immediately. Appropriate action may then be taken.

Further, in accordance with one embodiment of the present invention, the portable device 110 communicates with the first module 120 through the bi-directional signal 160, and is able to transmit other requests or data to the first RF module 120. As such, the portable device 110 is able to transmit a request to adjust the transmission strength of the first RF module 120 in order to adjust the detectable range or the predetermined distance, in accordance with one embodiment. In another embodiment, the portable device 110 is also able to transmit a request to change the authentication password or the identifying information in order to build up a channel for the first RF module 120 and the second RF module 140. In still another embodiment, the first RF module 120 can also send a status indication signal to the portable device 110.

In one embodiment, the first RF module 120 has identification data. The wireless signal 130 transmitted from the first RF module 120 to the second RF module 140 contains the identification data. Additionally, the second RF module 140 contains preset identification data. When the second RF module 140 receives the wireless signal 130, the identification data will also be received and decoded. The received identification data will be compared with the preset identification data to confirm whether the wireless signal 130 is transmitted from the specific first RF module 120. As such, this enables one-to-one association between the first RF module 120 and the second RF module 140 for purposes of theft and loss protection.

In accordance with another embodiment of the present invention, the wireless signal 130 contains event information pertaining to the first RF module or the portable device 110. For example, the portable device 110 is a cellular phone. When there is an incoming call, the cellular phone 110 is capable of informing the first RF module 120 via the bi-directional signal 160 of the incoming call. Thereafter, the first RF module 120 is capable of sending wireless signal 130 to RF module 140 that also contains the event information for the incoming call. As a result, the second RF module 140 receives the wireless signal 130 as well as the event information. Thereafter, the second RF module 140 transmits a signal 170 to the handheld device 180 to generate an alert to remind or notify the user of the event (e.g., incoming call). The event can be of various types, such as a call ring for a cellular phone, or a scheduled alarm of PDA.

In accordance with one embodiment of the present invention, the first RF module 120 comprises integrated chips, antennas, discrete electronic components, printed circuit boards, and some software or firmware. The second RF module 140 also comprises integrated chips, antennas, discrete electronic components, printed circuit boards, and some software or firmware. The first RF module 120 transmits the wireless signal 130 through the antenna 122 according to a coding and modulation scheme, and the second RF module 140 receives and decodes the wireless signal 130. According to one embodiment, the second RF module 140 also transmits a wireless signal 150 according to a coding and modulation scheme. The first RF module 120 is configured to receive the wireless signal 150. The type and frequency range of wireless signals 130 and 150 may be different for different applications.

Moreover, when the second RF module 140 is actuated to generate an alert, a signal 170 including a status indication is sent from the second RF module 140 to the handheld device 180 to allow the handheld device 180 to generate the alert. The alert also can be provided in various forms, such as sound, flashing light, or vibration. Alternatively, the handheld device 180 includes a display, not shown, for displaying various information from the second RF module 140.

In accordance with another embodiment of the present invention, according to a different application requirement and cost target, the first RF module 120 does not include the capability to receive wireless signals. As such, the first RF module 120 only receives instructions from the portable device 110 through the bi-directional signals 160, and only transmits wireless signals to the second RF module 140. In the present embodiment, the second RF module 140 performs as a receiver. The second RF module 140 only receives wireless signals rather than transmits wireless signals.

In accordance with still another embodiment of the present invention, there may be several RF modules in one tracking system to keep track of several portable devices at the same time. In this case, one of the RF modules may be selected to serve as a second RF module, which is also designated as a main controller, and the rest of the RF modules will each act as first RF modules. The first RF modules are basically controlled by the second RF module. The first RF modules are also embedded in various portable devices and can be controlled by the user interface provided by the portable devices. In one embodiment, any of the acting first RF modules can be completely turned off by its corresponding portable device, or by the second RF module.

In accordance with one embodiment of the present invention, the second RF module 140 transmits the wireless signal 150 while the first RF module 120 is programmed to receive the wireless signal 150. The tracking system 100 utilizes the bidirectional wireless transmission capabilities to realize power-off/wake-up function, or to send signals indicating low battery power to the user. The handheld device 180 can transmit a wireless signal 150 through the second RF module 140 to the first RF module 120 of the portable device 110 in order to turn off or wake up the portable device 110.

A similar mechanism can be utilized to locate the portable device 110 using the second RF module 140, in accordance with one embodiment of the present invention. The user may actuate a locating function (e.g., push a button on the handheld device 180) that instructs the second RF module 140 to send a message to the first RF module 120 through the wireless signal 150. In turn, the first RF module 120 will pass the message to the portable device 110. The message instructs the portable device 110 to perform some action indicating its location. For example, as a result, an audio signal or visual signal may be transmitted from the portable device 110 so as to help the user to locate the portable device 110.

In accordance with another embodiment of the present invention, the tracking system 100 can also have a pause mode. In this pause mode, the first RF module 120 and the second RF module 140 are turned off to save power consumption when the owner feels it is not necessary to keep tracking the portable device 110, such as when the portable device 110 is in use.

Figure 2:
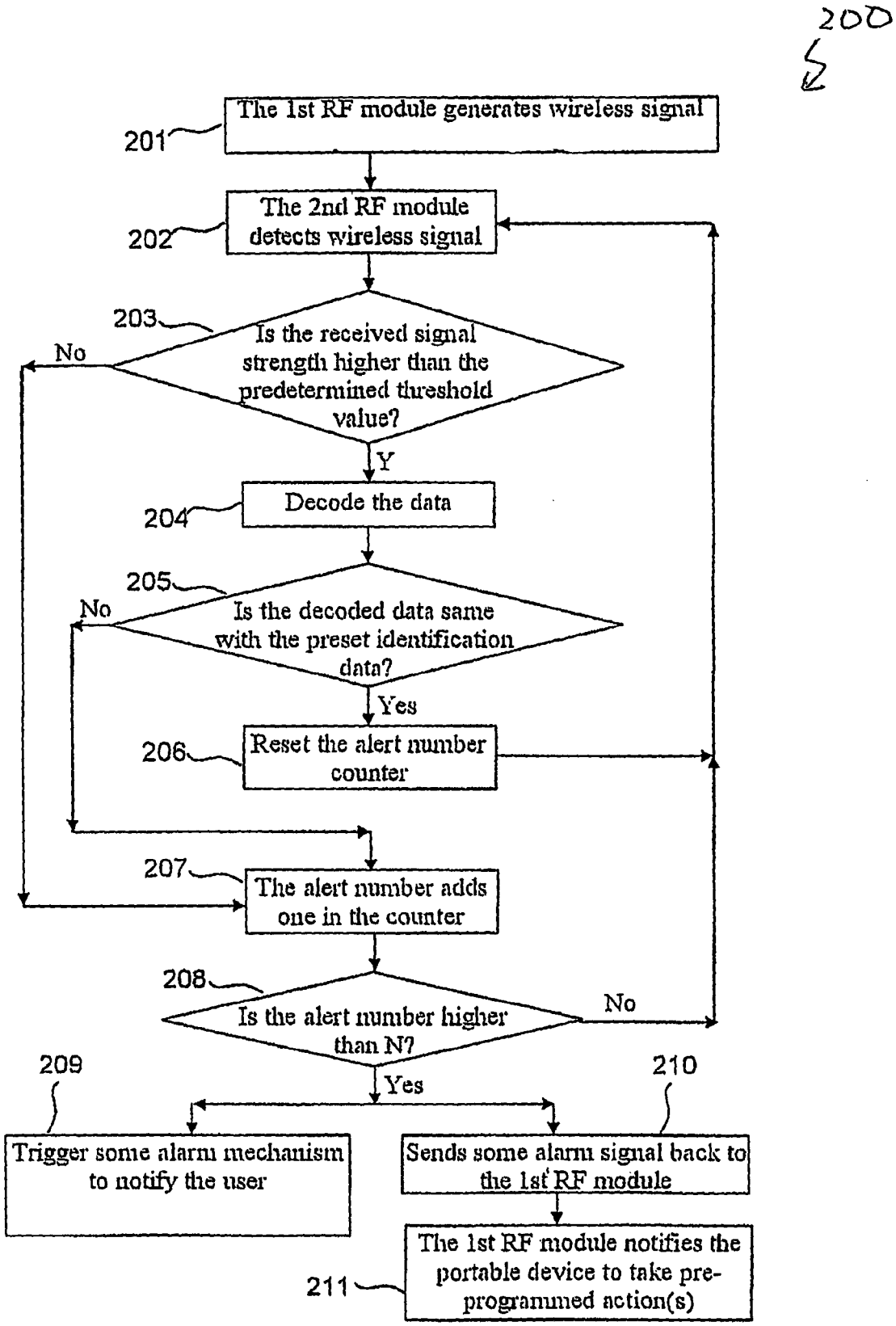
FIG. 2 is a flow chart of a method for the distance tracking function, in accordance to one embodiment of the present invention.

Referring to FIG. 2, a method 200 for tracking the distance between first and second RF modules according to one embodiment of the present invention is illustrated. At 201, a first RF module of a portable device will generate a wireless signal randomly according to the request of the portable device 110 and transmit the wireless signal out through an antenna of the first RF module. The wireless signal is sent out in a burst mode to save power, in one embodiment. In order to prevent the collision or interference of different wireless signals from different portable devices, the time interval of the wireless signal will be generated randomly with a random timing generator, in another embodiment. In still another embodiment, the first RF module is programmed to transmit the wireless signal periodically and automatically without the request from the portable device. The wireless signal contains an identifier for identifying the first RF module, in another embodiment. time interval of the wireless signal will be generated randomly with a random timing generator, in another embodiment. In still another embodiment, the first RF module is programmed to transmit the wireless signal periodically and automatically without the request from the portable device. The wireless signal contains an identifier for identifying the first RF module, in another embodiment.

At 202, a second RF module of a handheld device is actuated or activated to receive the wireless signal. It will be apparent to those skilled in the art that the received wireless signal will be processed with several operations in accordance with embodiments of the present invention, such as current-voltage conversion, amplification, filtering, etc. These operations can be realized through various kinds of circuit structure.

At 203, the processed signal is compared with a predetermined threshold value to determine if the wireless signal is strong enough. If the processed signal is larger than a predetermined value in the second RF module, the method 200 will go to 204. If not, the method 200 will go to 207. If the processed signal is strong enough, the portable device is still located within a predetermined or safe distance of the owner or the holder of the handheld device. The predetermined threshold value can be customized by the owner through the portable device 110. In one embodiment, the customized predetermined threshold value is sent to the second RF module via the wireless signal. In another embodiment, the predetermined threshold value can be programmed through the second RF module.

At 204, in accordance with one embodiment of the present invention, additional information, such as identification data or the predetermined threshold value, is modulated or encoded into the wireless signal of the first RF module, and the received signal of the second RF signal will be decoded by a decoder. As such, that additional information will be recovered according to the specific coding scheme.

At 205, the recovered identification data is compared with a preset identification data, which is stored in the second RF module. As such, if there are several portable devices including several first RF modules within a close range, such as in a very crowded environment, the identification data can be used to identify a specific wireless signal from a specific first RF module. If the identification data is correct, the present embodiment proceeds to 206. If not or the authentication fails, the present embodiment proceeds to 207.

At 206, the second RF module will reset a counter stored in the second RF module to zero, and then the present embodiment proceeds back to step 202 to monitor the next wireless signal.

At 207, the number of un-receivable signals is counted. In other words, a period of time is measured from the last valid receivable signal. More specifically, un-receivable signals include when the second RF module does not receive the wireless signal from the first RF module, or receives a wireless signal from the first RF module which is too weak. More specifically, a value (e.g., one) is added to the counter each time when the step 207 is executed.

At 208, the counter is compared with a predetermined or preset number N. A higher N means the less possibility of false alarm due to marginal reception and the higher risk of the portable device being too far away from the second RF module. If the counter is less than N, then the present embodiment proceeds back to 202 to continuously monitor the wireless signal from the first RF module. If the counter is higher than N, then the present embodiment proceeds to 209, and optionally proceeds to 210.

At 209, an alert is asserted or actuated to trigger an alarm mechanism, such as a flashing light, vibration, or beeping sound, or any other indicating method to notify the user that the portable device may be stolen or temporarily misplaced or forgotten.

An alert signal can be transmitted from the second RF module to the first RF module in the portable device. The first RF module will send a signal to the portable device instructing the portable device to generate indicating or alerting signals, such as a flashing light or beeping sound, or even to lock the portable device.

Figure 3:
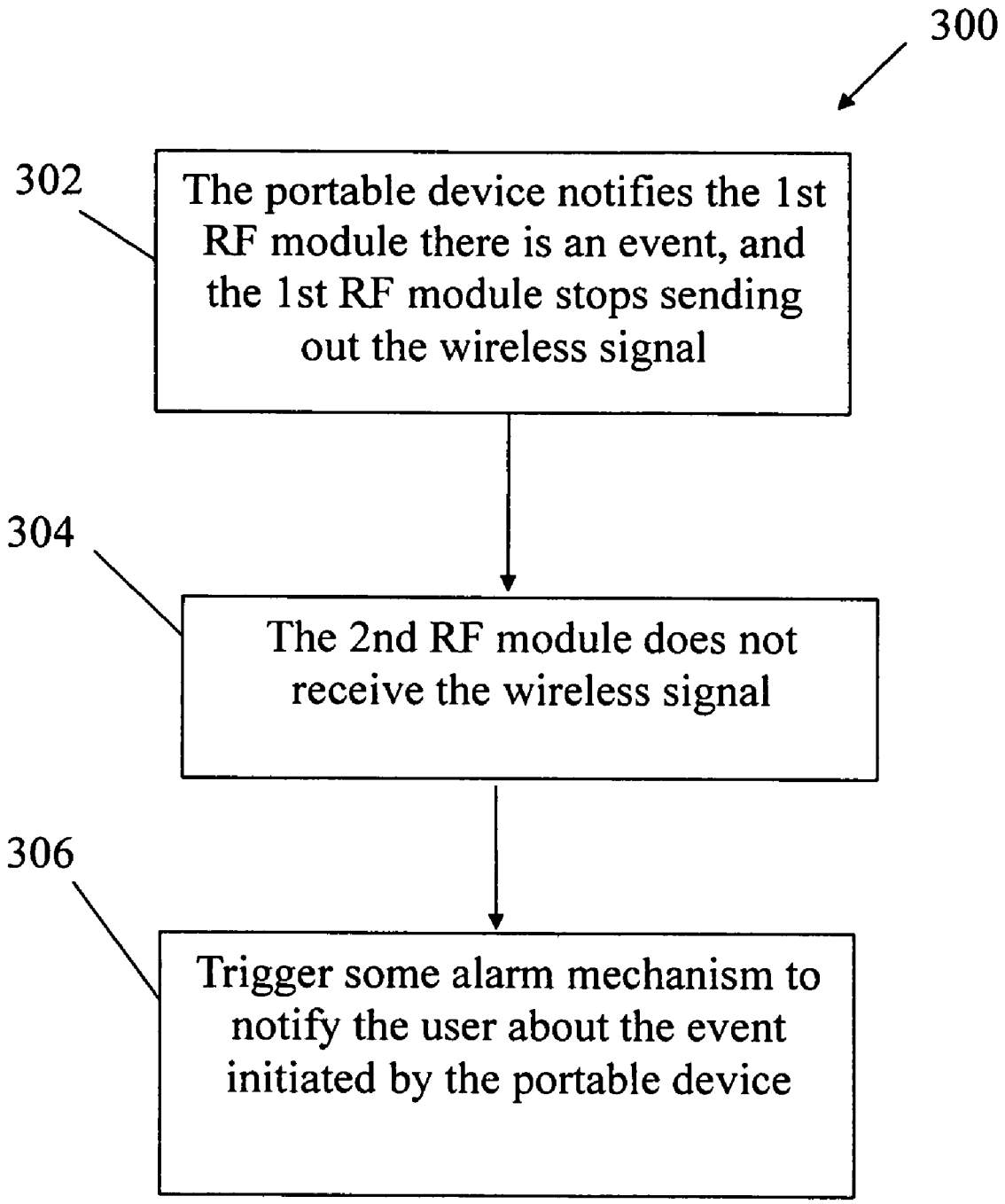
FIG. 3 is a flow chart of the event notification function, in accordance with one embodiment of the present invention.

Referring to FIG. 3, a method 300 for providing an event notification function is illustrated, in accordance with one embodiment of the present invention. The event could be varied in different applications. For purposes of illustration only, the portable device is described as a cellular phone in the present example. Other embodiments are well suited to the tracking of other portable devices, such as personal digital assistants, key chains, portable music players, etc. The event may include but is not limited to the following: an incoming call, the arrival of a text message or email, the reminder to charge the battery or a reminder signal of a meeting schedule.

At 302, the portable device notifies the first RF module of an event, and the first RF module stops sending out the wireless signal. In one embodiment, once the portable device notifies the first RF module of an event, the first RF module 120 can be turned completely off for power management.

At 304, since there are no wireless signals being sent from the first RF module, the second RF module cannot detect any wireless signal. As such, similar to the method 200 described hereinbefore, the second RF module senses that the portable device associated with the first RF module is located a distance that is greater than a predetermined threshold from the second RF module.

At 306, an alarm mechanism is triggered to notify the user of the event of the portable device 110. In the present embodiment, the event is predefined and known to the second RF module. As such, in the present embodiment the absence of the wireless signal indicates that the predefined event has occurred. In this embodiment shown in FIG. 3, the notification of the event of the portable device is similar to that of the distance tracking alarm function.

Figure 4:
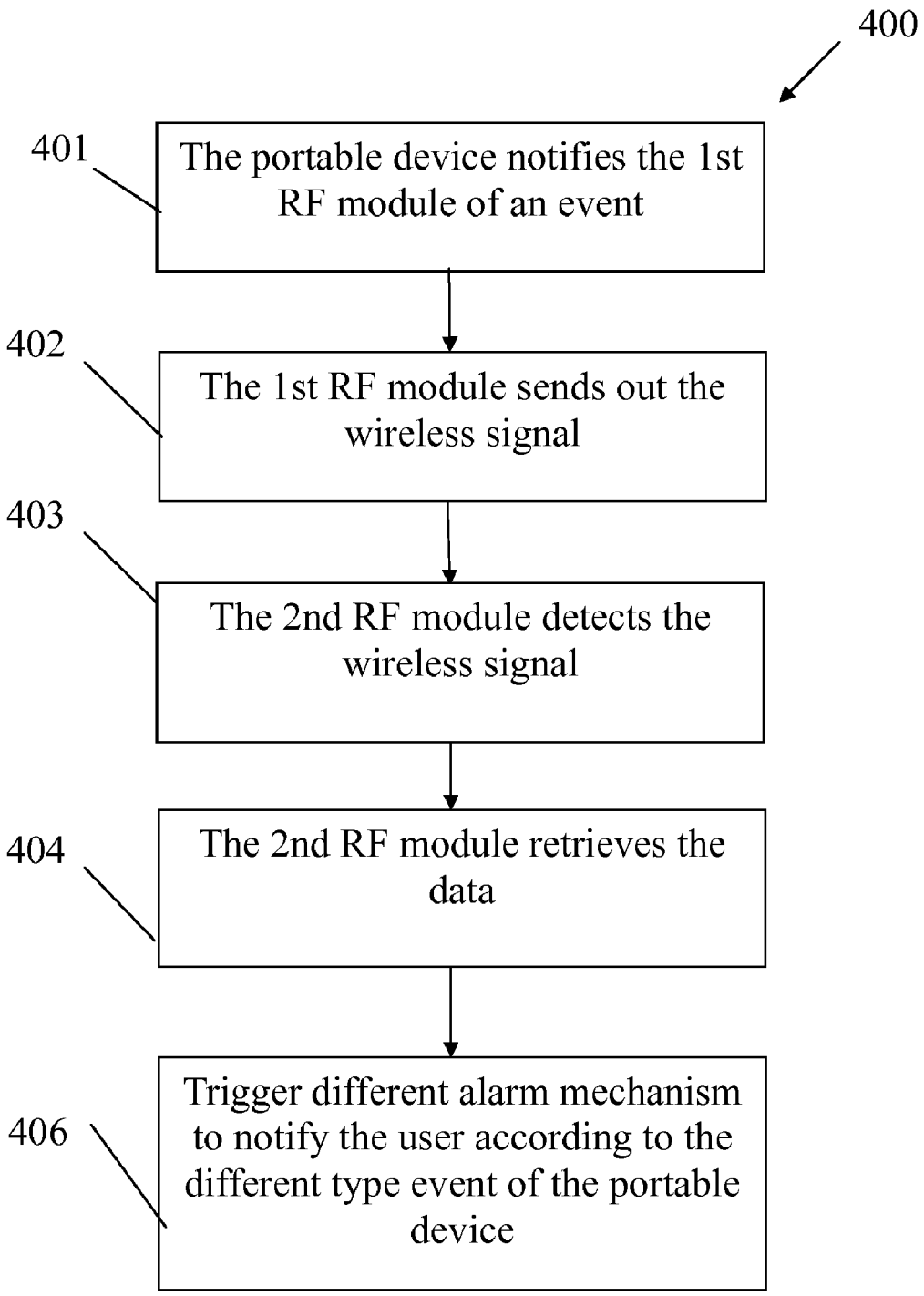
FIG. 4 is a flow chart of the event notification function, in accordance with another embodiment of the present invention.

Referring to FIG. 4, a method 400 for providing an event notification function according to yet another embodiment of the present invention is illustrated. In this embodiment, the notification of the event is served with different indications. As such, the owner or the user of a portable device is able to distinguish different events, such as an incoming call, the arrival of a text message or email, the reminder to charge the battery or a reminder signal of a meeting schedule.

At 401, the portable device notifies a first RF module of an event as well as the type of the event. As described hereinbefore, the portable device communicates with the first RF module through a bi-directional signal.

At 402, the first RF module will modulate or encode data which indicate the type of the event. The first RF module sends the data out through a wireless signal. In one embodiment, identification information is also encoded and sent out through the wireless signal.

At 403, the second RF module 140 detects the wireless signal. At 404, the second RF module retrieves the data. Thereafter, at 406, the second RF module will trigger an alarm mechanism to notify the owner. Different alarms may be triggered according to different types of events, such as using different sounds or different flash colors. It should be noted that these steps in FIG. 4 can also be used to order this tracking system to enter a pause mode for saving power. Based on different applications, some of the steps shown in the above figures may be omitted or be different. From the above detailed detail description accompanying the drawings, it is apparent to the those skilled in the art that this invention provides a method and a system of instant distance tracking function and event notification function within a short distance through wireless techniques.

While the foregoing description and drawings represent the preferred embodiments of the present invention, it will be understood that various additions, modifications and substitutions may be made therein without departing from the spirit and scope of the principles of the present invention as defined in the accompanying claims. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A tracking system, comprising:

a portable device;

a first Radio Frequency (RF) module installed in said portable device for transmitting a first wireless signal to a handheld device having installed therein a second RF module for receiving said first wireless signal, wherein, when a received amplitude of said first wireless signal received by said second RF module is less than a predetermined value, said second RF module generates an alert, wherein said tracking system is operable for implementing a pause mode, wherein in said pause mode said first RF module and said second RF module are turned off when said portable device is in use, wherein said second RF module enters said pause mode in response to a wireless signal received from said first RF module.

2. The tracking system of claim 1, wherein said first wireless signal comprises event information pertaining to said portable device, and wherein said second RF module generates an event alert to notify a user of said event when said event occurs.

3. The tracking system of claim 1, wherein said first RF module stops transmitting said first wireless signal when said portable device has an event, and wherein said second RF module generates said alert to notify a user of said event, since said second RF module does not receive said wireless signal.

4. The tracking system of claim 1, wherein said second wireless signal is also used as a locating signal, such that when said first RF module receives said second wireless signal said portable device generates a locating alert.

5. The tracking system of claim 1, wherein said portable device comprises a notebook computer.

6. The tracking system of claim 1, wherein said portable device comprises a cellular phone.

7. A method for tracking a portable device, comprising:

receiving a first wireless signal at a second RF module, said first wireless signal transmitted from a first RF module which is installed in said portable device;

reading an amplitude of said received wireless signal;

comparing said amplitude with a predetermined value;

generating an alert when said amplitude is lower than said predetermined value; and implementing a pause mode when said portable device is in use, wherein in said pause mode said first RF module and said second RF module are turned off, wherein said second RF module enters said pause mode in response to a wireless signal received from said first RF module.

8. The method of claim 7, wherein said first wireless signal is periodically transmitted from said first RF module.

9. The method of claim 7, wherein said first wireless signal is continuously transmitted from said first RF module.

10. The method of claim 8, further comprising:

incrementing a number each time said amplitude is lower than said predetermined value; and generating said alert when said number is larger than a predetermined number.

11. The method of claim 8, further comprising:

stopping transmission of said wireless signal when an event associated with said portable device occurs; and generating said alert when said amplitude of said received wireless signal is lower than said predetermined value.

12. The method of claim 7, further comprising:

receiving an event wireless signal that is transmitted from said first RF module when an event associated with said portable device occurs; and generating an event alert to notify a user of said event.

13. The method of claim 7, wherein said portable device comprises a notebook computer.

14. The method of claim 7, further comprising:

transmitting a locating wireless signal from said second RF module to said first RF module, wherein said portable device generates a locating alert in response to said locating wireless signal.

15. The method of claim 7, further comprising:

transmitting an alert wireless signal from said second RF module to said first RF module, wherein said portable device is locked in response of said alert wireless signal.

16. The method of claim 7, wherein said generating said alert further comprises:

generating said alert when said amplitude is lower than said predetermined value for a predetermined time period.

17. The method of claim 7, further comprising:

receiving an adjusting wireless signal from said first RF module; and adjusting said predetermined value in response to said adjusting wireless signal.

18. The tracking system of claim 2 wherein different event alerts are triggered in response to different types of events.

19. The tracking system of claim 1, wherein said second RF module generates a second wireless signal comprising a waking up signal that is transmitted by said second RF module to said first RF module, such that when said first RF module receives said second wireless signal and said portable device is in a sleep mode, said portable device is awakened.

* * * * *